United States Patent [19]

Schladitz

[11] 4,106,891

[45] Aug. 15, 1978

[54] ELECTRICAL HEATING DEVICE

[76] Inventor: Hermann J. Schladitz, Plantschweg 74, Munich 60, Fed. Rep. of Germany

[21] Appl. No.: 723,982

[22] Filed: Sep. 16, 1976

Related U.S. Application Data

[63] Continuation-in-part of Ser. No. 534,432, Dec. 19, 1974, abandoned.

[51] Int. Cl.[2] ..... F23D 11/44

[52] U.S. Cl. ..... 431/208; 48/103

[58] Field of Search ..... 431/11, 207, 208, 240; 48/103; 219/381, 273, 39

[56] References Cited

U.S. PATENT DOCUMENTS

| | | | |
|---|---|---|---|
| 1,456,986 | 5/1923 | Leisten et al. | 48/103 |
| 2,286,854 | 6/1942 | Holthouse | 431/208 X |
| 2,507,464 | 5/1950 | So | 431/208 |
| 3,734,677 | 5/1973 | Murase et al. | 431/208 X |
| 3,869,242 | 3/1975 | Schladitz | 431/11 |

FOREIGN PATENT DOCUMENTS

| | | | |
|---|---|---|---|
| 1,096,375 | 12/1967 | United Kingdom | 219/381 |

*Primary Examiner*—Edward G. Favors
*Attorney, Agent, or Firm*—Kane, Dalsimer, Kane, Sullivan & Kurucz

[57] ABSTRACT

An electrical heating device employs a metallic felt body through which fluid to be heated is passed. The felt may be of polycrystalline metal whiskers, or non-metal whiskers or filaments with metal coating applied. The body is heated by contact with an element that is heated electrically. The fluid flows through the body in a relatively long path compared with the distance through which heat has to be conducted through the body from the element. The body is conveniently a hollow cylinder, the fluid flow being parallel to the axis and the heat being applied from the inner and outer tubes between which the felt body is disposed.

19 Claims, 7 Drawing Figures

ELECTRICAL HEATING DEVICE

This application is a continuation-in-part of application Ser. No. 534,432 filed Dec. 19, 1974, and now abandoned.

BACKGROUND OF THE INVENTION

The invention relates to electrical heating devices for the heating or vaporization of fluid. It is concerned with such devices having at least one porous body of inter-felted polycrystalline metal whiskers or metallized non-metallic whiskers or filaments, joined together metallically at their points of contact. The body is traversed by the medium to be heated and is itself heated by being in contact with a wall of good heat-conducting material. This may itself be an electrical heating element or be arranged to be heated by one.

Porous bodies which consist of interconnected polycrystalline metal whiskers or metallized non-metallic whiskers or filaments, such as $Al_2O_3$ whiskers, carbon, quartz or rock fibers, can be produced with an extremely large inner surface area for the volume of the envelope of the body. They have been used successfully as electrical heating resistance elements for the vaporization or atomizing of liquid fuels. Such direct heating by electric current in many cases causes trouble owing to the good electrical conductivity of such a porous body, it has been proposed to heat the body indirectly by electricity. The porous body is then arranged to be in heat-conductive contact with another element heated by electric current. It has been found that this indirect electric heating does indeed have considerable advantages from the point of view of the source of energy available, but by comparison with a whiskers skeleton heated by the direct passage of electric current it takes rather a long time to heat the fluid to a desired temperature, particularly when a cylindrical porous body of rather large diameter is used. This is because the central zone of such a body is warmed very much less strongly than the external zone, which is in the immediate vicinity of the heated wall surrounding the cylinder. A body with alternately arranged heating plates and whisker plates can produce more uniform heating of the whisker portions, but they are traversed radially from inside to outside and only a short dwell time is possible for the fluid to be heated. Such plates cannot be made with an unduly large diameter for constructional reasons. Therefore, in order to heat a determined volume of liquid in a given time to a desired temperature or even to vaporize it, the whisker plates must be heated to relatively high temperatures which, when heating or vaporizing hydrocarbons, intensifies their tendency to crack and therefore to form porechoking residues.

SUMMARY OF THE INVENTION

It is an object of this invention to provide an electric heating device using inter-felted whiskers of filaments which is simple in construction and allows rapid and uniform heating of the fluid.

According to the present invention there is provided an electrical heating device for the heating or vaporization of fluid, comprising at least one elongated porous body consisting of inter-felted polycrystalline metal whiskers or metallized non-metal whiskers or filaments connected metallically together at their points of contact, and arranged to be traversed in the longitudinal direction by the fluid to be heated, and at least one wall of heat conductive material bounding said body and being in conductive relationship therewith, said wall forming or having associated therewith an electric heating element.

In a preferred embodiment, the body is of hollow cylindrical form and is arranged to be traversed by the fluid in the direction of its axis. The two walls are conveniently inner and outer tubes bounding the cylinder.

In this embodiment, compared with a porous solid cylinder, there is no central zone which is at a considerable distance from a heat-emitting wall, and which therefore contributes only slightly to the heating of the fluid. There is therefore a considerable saving of whiskers and a more rapid and uniform heating of the fluid. With a solid cylinder, the outermost zone has to be excessively heated to compensate for the poor heating of the central zone, in order to attain the desired median temperature. In particular, for vaporization of liquid fuels, for instance fuel oil, diesel oil or petrol, difficulties occur with solid cylinders. It is not practical to heat such hydrocarbons beyond a given temperature since there is otherwise the risk of the formation of residues and cracking, and the excessively heated outer zone can promote this.

In a preferred form there is arranged on the outer tube at least, an electric heating coil. The cylinder and tubes conveniently form a unit in a lagged housing having at one end an inlet for the fluid to be heated and at the other end an outlet for the heated or evaporated fluid. Such an electric heating device can be used very satisfactorily for heating liquid fuels, and in particular for the evaporation of fuel oil. For this purpose the unit may be centrally mounted in a pipe for carrying the combustion air, and it can be arranged detachably on a cover which normally closes an aperture in the wall of said pipe. The outlet is preferably governed by a valve. In the event of a breakdown, the unit, or even the housing with the unit, can be removed and discarded and replaced by a new device.

The outer tube is conveniently electrically heated. The inner pipe may be too, or alternatively it may communicate with a waste gas pipe, so that the hot waste gases heat the inner tube.

Instead of a hollow cylinder, a thin oblong plate-like member may be adopted for the porous body. With this embodiment, it is desirable for the heating of liquid fuels, and in particular for the evaporation of fuel oil, for several such porous bodies with an electrically heated jacket to be arranged parallel to, but spaced from, one another, but at some distance apart, the intervening spaces between neighbouring plates acting as ducts for the passage of the combustion air.

For a better understanding of the invention some constructional forms thereof will now be described, by way of example, with reference to the accompanying drawings.

DESCRIPTION OF THE PREFERRED EMBODIMENTS

Figure 1:
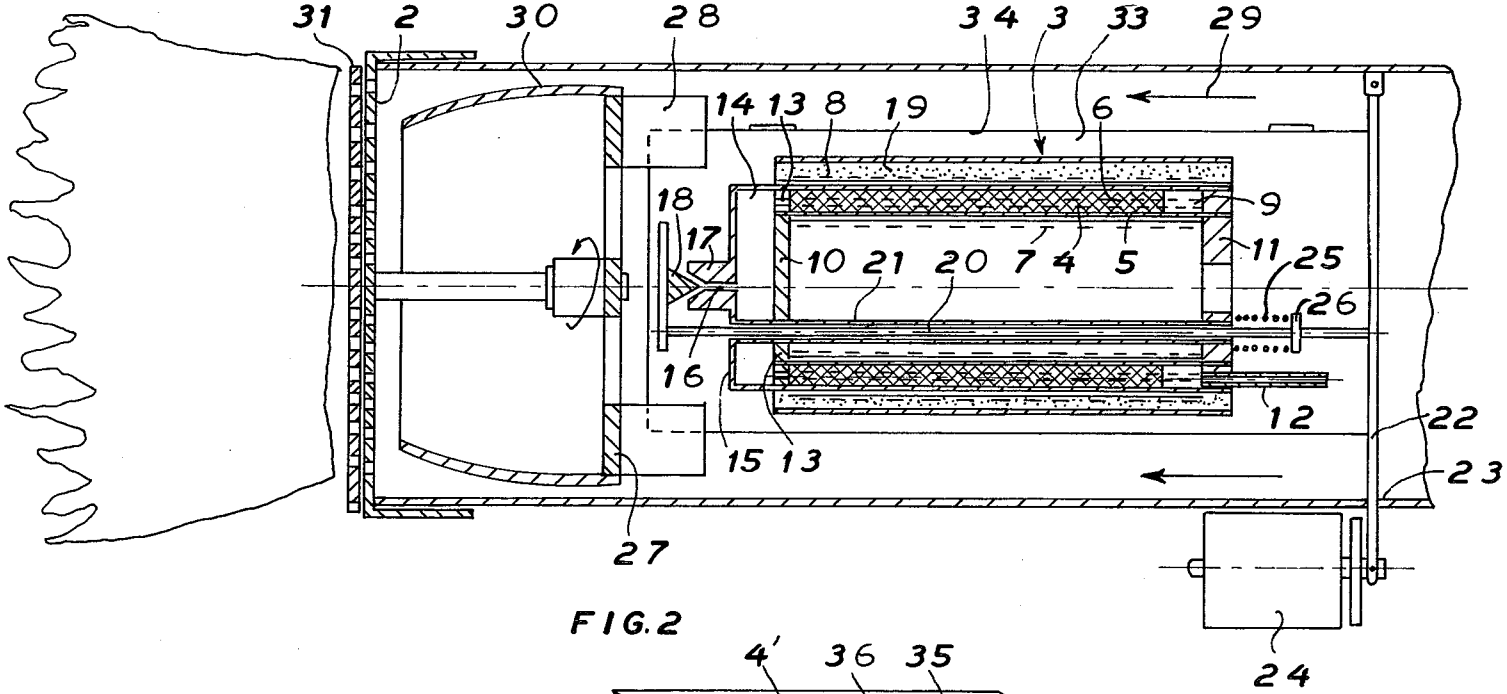
FIG. 1 is an axial section of part of an oil burner with a heating device according to the invention, for vaporizing the fuel oil.

The oil burner of FIG. 1 has a pipe 1 for carrying the air for combustion capped at its combustion chamber end by a perforated plate 2. Arranged centrally in the pipe is a cylindrical electrical heating device 3, which serves to evaporate the fuel oil to be mixed with the combustion air. The electric heating device 3 consists of a porous body 4 in the form of a hollow cylinder, which is bounded by an inner tube 5 and an outer tube 6. The porous body 4 is made of inter-felted polycrystalline metal whiskers or metallized non-metallic whiskers or filaments which are metallically bounded at their points of contact. The body 4 is arranged to have good heat communication with both tubes 5 and 6, this being achieved for instance by sintering on or by deposition of metal, for preference by thermal decomposition of a metal compound, in particular a metal carbonyl. The inner tube 5 is provided on its inner surface and the outer tube 6 on its outer surface with respective electrical heating coils 7 and 8, which can be connected with a source of electric current (not shown). The space within the inner tube 5 and the intervening annular space 9 between the tubes 5 and 6 containing the porous body 4 are capped at their ends by covers 10 and 11.

An oil supply pipe 12 delivers through the cover 11 into the end of space 9 remote from plate 2. The cover 10 provides a number of outlet apertures 13 from the other end of space 9, opening into a shallow cylindrical chamber 14 which is bounded by the cover 10, and extended end portion of the outer tube 6 and an end plate 15 for the outer tube 6. The chamber 14 has a central outlet aperture 16 in plate 15 with a valve seat 17 which acts in conjunction with a valve body 18 in a manner to be described below. The outer tube 6 is surrounded by a heat-insulating housing 19 at least in the zone of the electric heating coil 8.

The valve body 18 is attached to a rod 20 which passes through a guide tube 21 in the heating device 3 to rest against a pivotable rod 22 spanning the pipe 1. This rod 22 protrudes through an aperture 23 in the pipe 1 and is linked to the armature of an electromagnet 24. A spring 26 acting between the cover 11 of the heating device 3 and a collar 26 on the rod 20 urges the valve body 18 onto the valve seat 17. When the electromagnet 24 is excited, the rod 22 is pivoted into the position shown in which the rod 20 has moved to the left and the valve body 18 has been lifted from the valve seat 17.

The pipe 1 also contains, at the downstream end, a freely rotatable auxiliary blower wheel 27 with blades or vanes 28. This is driven by the current of air flowing as indicated by the arrows 29. The purpose of the blower wheel 27 with its vanes 28 is to mix the oil vapor emerging from the aperture 16, when the vanes 1, 18 is opened, intensively with the combustion air. To prevent any small drops of oil present from being hurled outward against the wall of the pipe 1, and from exerting an unfavourable influence on combustion in the marginal zone of the perforated plate 2, the blower wheel 27 is surrounded by a casing 30 which tapers towards the perforated plate 2 and ensures that non-vaporized drops of fuel oil are guided into the central region of the pipe 1. To adjust the volume of air-fuel mixture admitted to the combustion chamber, it is possible to arrange outside the perforated plate 2 a second perforated plate 31 which can be twisted or moved so that its perforations are brought more or less into coincidence with the perforations of the plate 2, as required.

In operation, the combustion air is supplied through the pipe 1 by means of a blower (not shown), and the auxiliary blower wheel 27 is caused to rotate. At the same time fuel oil is supplied through the pipe 12 and the porous body 4 is heated by connecting the heating coils 7 and 8 to a source of electrical current. The fuel oil flowing through the porous body 4 is then vaporized and the oil vapor passes through the outlet apertures 13 into the chamber 14. On switching on the burner, the electromagnet 24 is also excited, whereby the valve body 18 is lifted from its seat 17. The oil vapor can now emerge from the chamber 14 through the aperture 16 and mix with the combustion air. The oil vapor/air mixture passes through the apertures of the perforated plates 2, 31 and enters the combustion chamber, where it is ignited in the usual way. A blue, non-luminous flame is produced at a short distance from the outer perforated plate 31.

In the event of breakdowns, and in order to allow the rapid replacement of the electrical heating device 3, the latter can be arranged detachably on a cover 33, which closes an aperture 34 in the wall of the pipe 1. When the cover 33 is removed, the electrical heating device 3 can be removed as a complete unit, including the valve body 18. To allow this, the supply pipe 12 can be made flexible.

In an alternative arrangement, the auxiliary blower wheel 27 can also be driven by its own motor. The inner heating coil 7 can be omitted, particularly if the inner tube 5 is connected with a waste gas pipe (not shown). It can then be traversed by hot waste gases and heated by them. These hot waste gases can then be returned, if required, to the combustion chamber. Alternatively, each or both tubes can be heated directly by electric current flowing through them.

Figure 2:
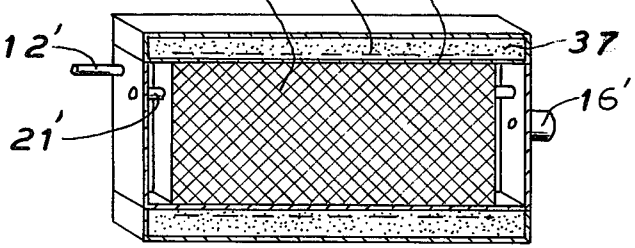
FIG. 2 is a perspective view, longitudinally sectioned, of a modified electrical heating device which could be used in the oil burner shown in FIG. 1.

FIG. 2 shows an electrical heating device which can be used instead of the heating device 3 in FIG. 1. This device contains a porous body 4' in the form of a thin oblong plate, which is surrounded by a jacket 35 of good heat-conducting material carrying an outer heating coil 36. The whole is surrounded by a lagged housing 37. 12' denotes the oil supply pipe, 21' the valve rod guide and 16' the continuation of the jacket 35 containing the valve seat and the outflow aperture, corresponding to the parts of FIG. 1 with the same references but unprimed.

Common to the two electrical heating devices shown in FIGS. 1 and 2 is the fact that in both cases the components of the porous bodies which are only warmed by heat conduction are at a slight distance from the electrically heated wall, so that rapid and uniform heating of the fluid flowing through them is obtained.

Of course, if necessary, several electrically heated porous bodies can be provided. For instance, several plate-shaped porous bodies corresponding to that of FIG. 2, with electrically heated jackets, can be arranged parallel to one another in a housing. The spaces between neighbouring plates can form passages for the combustion air, for example when the electrical heating device is to be used for vaporizing fuel oil inside an oil burner.

Figure 3:
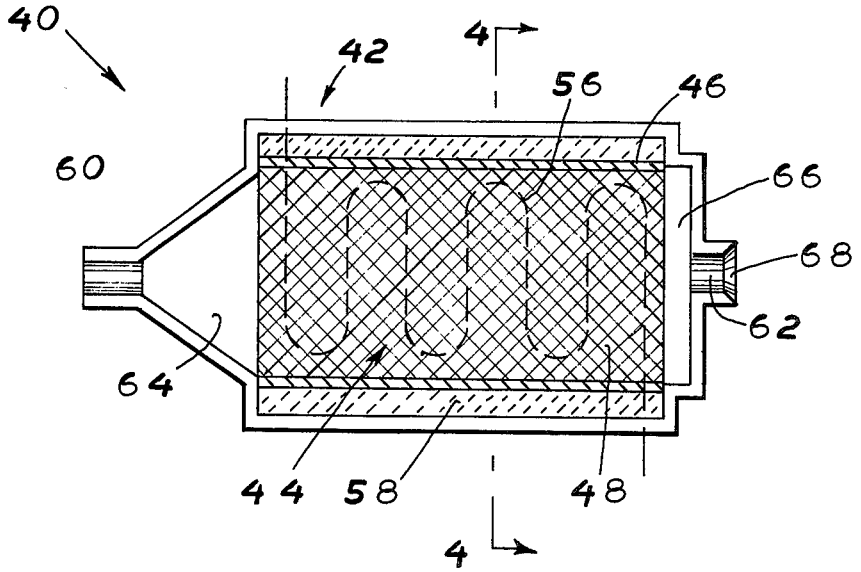
FIG. 3 is a longitudinal sectional view taken along line 3—3 in FIG. 4 of a further embodiment.
Figure 4:
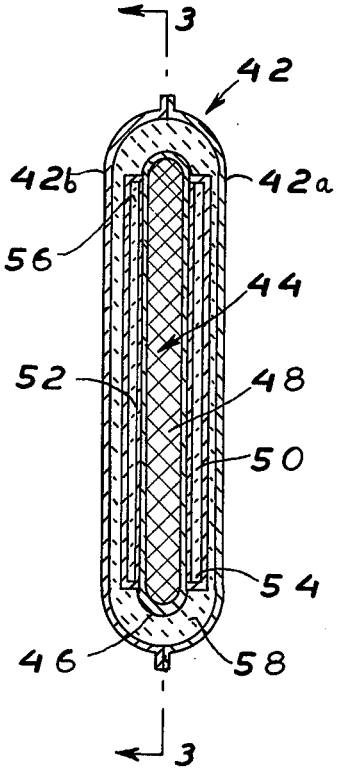
FIG. 4 is a cross sectional view taken along line 4—4 in FIG. 3 on an enlarged scale.

FIGS. 3 and 4 show an electric heating device 40 comprising an elongated casing 42 composed of two shells 42*a* and 42*b* which are connected to each other at their edges f.i. by spot-welding, beading or the like. A porous body 44 comprises a flat hull 46 which is filled with a felted mass 48 of polycrystalline metal whiskers or metal-coated non-metal whiskers. The hull 46 is formed from a pipe which has been pressed flat to a width of no more than 5 mm. For sake of clarity the dimensions are greatly exaggerated in the drawings. Electric heating elements 50 and 52 in the shape of flat plates each comprising an electric heating lead 54 and 56, respectively, lie on the side faces of the hull 46 of porous body 44 as can be seen from FIG. 4. The porous body 44 and the heating elements 50, 52 are surronded by a suitable heat insulation 58. The casing 42 is formed with an inlet connection 60 on one hand and with an outlet connection 62 on the other hand. The inlet connection 60 widens to a flat funnel-shaped portion 64 which corresponds with its right end to the cross sectional area of the porous body 44. The outlet connection 62 is in communication with a chamber 66 formed between the downstream end of porous body 44 and the casing 42. Furthermore outlet connection 62 is provided with a conical valve seat 68 for accommodating an outlet valve such as the valve 18 described in connection with FIG. 1. The liquid to be heated is supplied under pressure through inlet connection 60 and passes through the felted mass 48 of the porous body. The felted mass 48 is heated by the electric heating elements 50, 52 to such an extent that the desired heating of the liquid takes place. Owing to the small width of the porous body of no more than 5 mm, preferably 3 to 4 mm, a very fast and uniform heating of the felted mass is obtained by heat dissipation, and the cooling effect of the liquid on the felted mass is immediately compensated.

Figure 5:
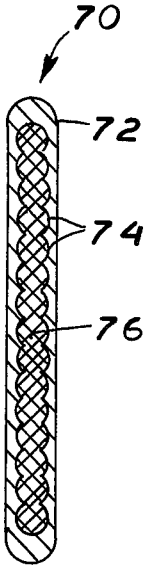
FIGS. 5, 6 and 7 are cross sectional views of three modified porous bodies according to the invention.

FIG. 5 shows a first alternative of the porous body which can be used in lieu of the porous body 44 in the heating device of FIGS. 3 and 4. That porous body 70 comprises a flat plate 72 of good heat-conducting material such as copper or aluminum having a shape which corresponds to the shape of hull 46 in FIGS. 3 and 4. Flat plate 72 is traversed in longitudinal direction by bores 74 which intersect each other to form an internal space with corrugated walls which have a greater surface than the straight walls of hull 46. The internal space of plate 72 is again filled with a felted mass 76 of polycrystalline metal whiskers or metal-coated non-metal whiskers.

Figure 6:
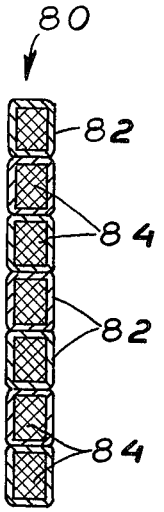
Figure 7:
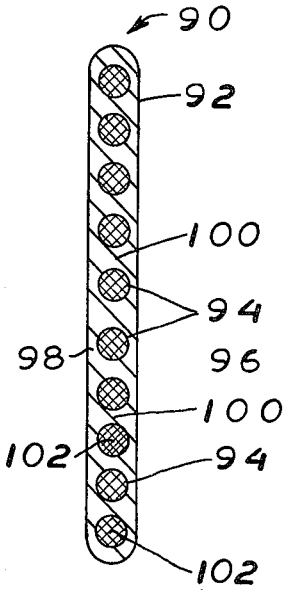

The porous bodies 44 and 70 of FIGS. 3, 4 and 5, respectively, are well suited for heating or vaporizing liquids supplied under low pressure. FIGS. 6 and 7 show alternatives of porous bodies which are particularly suited for heating or vaporizing liquids supplied at high pressures. The porous body 80 of FIG. 6 is comprised of a number of pipes 82 of rectangular cross-section which again are filled with a felted mass 84 of polycrystalline metal whiskers or metal-coated non-metal whiskers. The pipes 82 are stacked upon each other so that the external shape again corresponds in general to that of porous body 44. Preferably the pipes 82 are interconnected f.i. brazing, soldering or the like. It will be appreciated that the pipes 82 will withstand much higher internal pressures than the hull 47 or the plate 72.

The porous body 90 of FIG. 7 comprises a solid plate 92 similar to the flat plate 72 of FIG. 5 and made likewise of good heat-conducting material. Plate 92 is traversed by individual bores 94 which do not intersect each other as do the bores 74 of FIG. 5. Therefore the sidewalls 96 and 98 of plate 92 are interconnected by webs 100 between adjacent bores 94. This plate 92 can withstand even higher internal pressures than the porous body 80 of FIG. 6. The bores 94 are again filled with a felted mass 102 of the material mentioned above.

In regard to the above discussed embodiments, the thickness of the porous body should be between 2 and 5 mm. If the porous body is heated from both sides as is the case with the flat bodies of FIGS. 3 to 7 than it can be thicker i.e. 3 to 5 mm than in the case where it is heated from one side only, f.i. the tubular porous body 4 in FIG. 1 if only an external or only an internal heating coil is provided. In that case the porous body should have a thickness of no more than 3 mm. The thickness is measured always from the wall heated by the electric heating element. The whiskers have for practical reasons diameters between 0.5 and 10 microns whereby the thicker whiskers have a rough surface which acts as supports for the finer whiskers. The whiskers are either connected to each other by sintering to form a stable skeleton which is connected to the wall of the surrounding structure by sintering, brazing or metal deposition. A firm interconnection of the whiskers can also be obtained if the whiskers are made ductile by thermal treatment so that they are interlaced with each other through a pressing operation. In this case the whiskers felt is made up of individual sections and the pressing operation takes place after each filling charge.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. An electric heating device for the heating or vaporization of a liquid, comprising; at least one elongated porous body having a small dimension perpendicular to its longitudinal extension, said porous body consisting of a felted mass of polycrystalline metal whiskers or metal-coated non-metal whiskers metallically interconnected at their point of contact, said porous body being enclosed between walls of heat-conducting material along its longitudinal dimension, means for passing the liquid through the porous body in its longitudinal direction, an inlet connection for the liquid to be heated at one end face of the porous body and an outlet connection at the other end face, an electric heating element in direct contact with at least one of said walls, the small dimension of the porous body perpendicular to its longitudinal extension providing a thin cross section to facilitate an essentially uniform heating of the porous body by heat radiation from said heated wall and by heat conduction through the whiskers adjacent said wall to the whiskers more remote from said wall, said body is of hollow cylindrical form and is arranged to be traversed by the fluid to be heated in the direction of its axis and two said walls are provided in the form of an inner tube and an outer tube bounding said hollow cylinder.

2. The invention in accordance with claim 1 wherein an electric heating coil is arranged at least on the outer tube.

3. The invention in accordance with claim 1 wherein an electric heating coil is arranged within the inner tube.

4. The invention in accordance with claim 1 wherein said cylinder and tube form a unit, a lagged housing encloses said unit and said housing has at one end an inlet for the fluid to be heated and at the other end an outlet for the evaporated fluid.

5. The invention in accordance with claim 4 in combination with a pipe carrying combustion air, wherein said unit is centrally mounted in said pipe.

6. The invention in accordance with claim 5 wherein a cover normally closes an opening in the side of said pipe and said unit is arranged detachably thereon.

7. The invention in accordance with claim 4 wherein a valve is provided to govern said outlet.

8. An electric heating device for the heating or vaporization of a liquid, comprising; at least one elongated porous body having a small dimension perpendicular to its longitudinal extension, said porous body consisting of a felted mass of polycrystalline metal whiskers of metal-coated non-metal whiskers metallically interconnected at their point of contact, said porous body being enclosed between walls of heat-conducting material along its longitudinal dimension, means for passing the liquid through the porous body in its longitudinal direction, an inlet connection for the liquid to be heated at one end face of the porous body and an outlet connection at the other end face, an electric heating element in direct contact with at least one of said walls, the small dimension of the porous body perpendicular to its longitudinal extension providing a thin cross section to facilitate an essentially uniform heating of the porous body by heat radiation from said heated wall and by heat conduction through the whiskers adjacent said wall to the whiskers more remote from said wall, and said body being a plate-like member.

9. The invention in accordance with claim 8 wherein a housing encloses a plurality of said plate-like members, each with an electrically heated casing, arranged parallel to, but spaced from, one another, and the intervening spaces between neighboring plates form ducts for the passage of combustion air.

10. An electric heating device for the heating or vaporization of a liquid, comprising; at least one elongated porous body having a small dimension perpendicular to its longitudinal extension, said porous body consisting of a felted mass of polycrystalline metal whiskers or metal-coating non-metal whiskers metallically interconnected at their point of contact, said porous body being enclosed between walls of heat-conducting material along its longitudinal dimension, means for passing the liquid through the porous body in its longitudinal direction, an inlet connection for the liquid to be heated at one end face of the porous body and an outlet connection at the other end face, an electric heating element in direct contact with at least one of said walls, the small dimension of the porous body perpendicular to its longitudinal extension providing a thin cross section to facilitate an essentially uniform heating of the porous body by heat radiation from said heated wall and by heat conduction through the whiskers adjacent said wall to the whiskers more remote from said wall, the device including an elongated casing composed of two shells which are connected to each other at their edges, the porous body comprising a flat hull filled with the felted mass, and the hull being formed from a pipe having been pressed flat to a minimum predetermined width.

11. The invention in accordance with claim 10 wherein electric heating elements are in the shape of flat plates each comprising an electrical heating lead respectively lying on the side faces of the hull.

12. An electric heating device for the heating or vaporization of a liquid, comprising; at least one elongated porous body having a small dimension perpendicular to its longitudinal extension, said porous body consisting of a felted mass of polycrystalline metal whiskers or metal-coated non-metal whiskers metallically interconnected at their point of contact, said porous body being enclosed between walls of heat-conducting material along its longitudinal dimension, means for passing the liquid through the porous body in its longitudinal direction, an inlet connection for the liquid to be heated at one end face of the porous body and an outlet connection at the other end face, an electric heating element in direct contact with at least one of said walls, the small dimension of the porous body perpendicular to its longitudinal extension providing a thin cross section to facilitate an essentially uniform heating of the porous body by heat radiation from said heated wall and by heat conduction through the whiskers adjacent said wall to the whiskers more remote from said wall, the porous body comprising an outer hull of good heat-conductive material having the configuration of a flattened pipe so as to form a flat plate, the flat plate being traversed in longitudinal direction by bores which intersect each other to form an internal space surrounded by corrugated walls, and the internal space being filled with the felted mass.

13. An electric heating device for the heating or vaporization of a liquid, comprising; at least one elongated porous body having a small dimension perpendicular to its longitudinal extension, said porous body consisting of a felted mass of polycrystalline metal whiskers or metal-coated non-metal whiskers metallically interconnected at their point of contact, said porous body being enclosed between walls of heat-conducting material along its longitudinal dimension, means for passing the liquid through the porous body in its longitudinal direction, an inlet connection for the liquid to be heated at one end face of the porous body and an outlet connection at the other end face, an electric heating element in direct contact with at least one of said walls, the small dimension of the porous body perpendicular to its longitudinal extension providing a thin cross section to facilitate an essentially uniform heating of the porous body by heat radiation from said heated wall and by heat conduction through the whiskers adjacent said wall to the whiskers more remote from said wall, the porous body including a casing formed of a number of pipes of rectangular cross section filled with the felted mass, the pipes being stacked upon each other so that the external shape of the porous body assumes the configuration of a flattened pipe.

14. An electric heating device for the heating or vaporization of a liquid, comprising; at least one elongated porous body having a small dimension perpendicular to its longitudinal extension, said porous body consisting of a felted mass of polycrystalline metal whiskers or metal-coated non-metal whiskers metallically interconnected at their point of contact, said porous body being enclosed between walls of heat-conducting material along its longitudinal dimension, means for passing the liquid through the porous body in its longitudinal direction, an inlet connection for the liquid to be heated at one end face of the porous body and an outlet connection at the other end face, an electric heating element in direct contact with at least one of said walls, the small dimension of the porous body perpendicular to its longitudinal extension providing a thin cross section to facilitate an essentially uniform heating of the porous body by heat radiation from said heated wall and by heat conduction through the whiskers adjacent said wall to the whiskers more remote from said wall, the porous body having an outer hull with a configuration like that of a flatened pipe so as to form a flat plate, the hull being traversed by individual separated bores so that the sidewalls of the hull are interconnected by webs between adjacent bores, and the bores being filled with the felted mass.

15. An electric heating device for the heating or vaporization of a liquid, comprising; at least one elongated porous body having a small dimension perpendicular to its longitudinal extension, said porous body consisting of a felted mass of polycrystalline metal whiskers or metal-coated non-metal whiskers metallically interconnected at their point of contact, said porous body being enclosed between walls of heat-conducting material along its longitudinal dimension, means for passing the liquid through the porous body in its longitudinal direction, an inlet connection for the liquid to be heated at one end face of the porous body and an outlet connection at the other end face, an electric heating element in direct contact with at least one of said walls, the small dimension of the porous body perpendicular to its longitudinal extension providing a thin cross section to facilitate an essentially uniform heating of the porous body by heat radiation from said heated wall and by heat conduction through the whiskers adjacent said wall to the whiskers more remote from said wall, said body is of hollow cylindrical form and is arranged to be traversed by the fluid to be heated in the direction of tis axis and two said walls are provided in the form of an inner tube and an outer tube bounding said hollow cylinder, and said wall forming an electrical heating element.

16. An electric heating device for the heating or vaporization of a liquid, comprising; at least one elongated porous body having a small dimension perpendicular to its longitudinal extension, said porous body consisting of a felted mass of polycrystalline metal whiskers or metal-coated non-metal whiskers metallically interconnected at their point of contact, said porous body being enclosed between walls of heat-conducting material along its longitudinal dimension, means for passing the liquid through the porous body in its longitudinal direction, an inlet connection for the liquid to be heated at one end face of the porous body and an outlet connection at the other end face, an electric heating element in direct contact with at least one of said walls, the small dimension of the porous body perpendicular to its longitudinal extension providing a thin cross section to facilitate an essentially uniform heating of the porous body by heat radiation from said heated wall and by heat conduction through the whiskers adjacent said wall to the whiskers more remote from said wall, and said body being a plate-like member, and said wall forming an electrical heating element.

17. An electric heating device for the heating or vaporization of a liquid, comprising; a least one elongated porous body having a small dimension perpendicular to its longitudinal extension, said porous body consisting of a felted mass of polycrystalline metal whiskers or metal-coated non-metal whiskers metallically interconnected at their point of contact, said porous body being enclosed between walls of heat-conducting material along its longitudinal dimension, means for passing the liquid through the porous body in its longitudinal direction, an inlet connection for the liquid to be heated at one end face of the porous body and an outlet connection at the other end face, an electric heating element in direct contact with at least one of said walls, the small dimension of the porous body perpendicular to its longitudinal extension providing a thin cross section to facilitate an essentially uniform heating of the porous body by heat radiation from said heated wall and by heat conduction through the whiskers adjacent said wall to the whiskers more remote from said wall, said body is of hollow cylindrical form and is arranged to be traversed by the fluid to be heated in the direction of its axis and two said walls are provided in the form of an inner tube and an outer tube bounding said hollow cylinder, and the porous body having a thickness of between approximately 2 and 5 mm.

18. An electric heating device for the heating or vaporization of a liquid, comprising; at least one elongated porous body having a small dimension perpendicular to its longitudinal extension, said porous body consisting of a felted mass of polycrystalline metal whiskers or metal-coated non-metal whiskers metallically interconnected at their point of contact, said porous body being enclosed between walls of heat-conducting material along its longitudinal dimension, means for passing the liquid through the porous body in its longitudinal direction, an inlet connection for the liquid to be heated at one end face of the porous body and an outlet connection at the other end face, an electric heating element in direct contact with at least one of said walls, the small dimension of the porous body perpendicular to its longitudinal extension providing a thin cross section to facilitate an essentially uniform heating of the porous body by heat radiation from said heated wall and by heat conduction through the whiskers adjacent said wall to the whiskers more remote from said wall, and said body being a plate-like member, and the porous body having a thickness of between approximately 2 and 5 mm.

19. An electric heating device for the heating or vaporization of a liquid, comprising; at least one elongated porous body having a small dimension perpendicular to its longitudinal extension, said porous body consisting of a felted mass of polycrystalline metal whiskers or metal-coated non-metal whiskers metallically interconnected at their point of contact, said porous body being enclosed between walls of heat-conducting material along its longitudinal dimension, means for passing the liquid through the porous body in its longitudinal direction, an inlet connection for the liquid to be heated at one end face of the porous body and an outlet connection at the other end face, an electric heating element in direct contact with at least one of said walls, the small dimension of the porous body perpendicular to its longitudinal extension providing a thin cross section to facilitate an essentially uniform heating of the porous body by heat radiation from said heated wall and by heat conduction through the whiskers adjacent said wall to the whiskers more remote from said wall, and said wall forming an electrical heating element.

* * * * *